United States Patent [19]

Ruth et al.

[11] 4,267,129

[45] May 12, 1981

[54] CARBURETOR BOWL VENT

[75] Inventors: Harvey L. Ruth, St. Louis; Michael H. Schneider, Chesterfield; Michael B. Phelan, Florissant, all of Mo.

[73] Assignee: ACF Industries, Incorporated, New York, N.Y.

[21] Appl. No.: 92,751

[22] Filed: Nov. 9, 1979

[51] Int. Cl.[3] ..... F02M 5/08

[52] U.S. Cl. ..... 261/72 R; 261/DIG. 67; 261/DIG. 74; 123/519

[58] Field of Search ..... 261/DIG. 67, DIG. 74, 261/72 R; 123/519

[56] References Cited

U.S. PATENT DOCUMENTS 3,548,797 12/1970 Hagihara et al. ..... 261/DIG. 67
4,157,366 6/1979 Ruth et al. ..... 261/DIG. 74

FOREIGN PATENT DOCUMENTS 1365889 9/1974 United Kingdom ..... 261/DIG. 67

*Primary Examiner*—Tim R. Miles
*Attorney, Agent, or Firm*—J. Joseph Muller

[57] ABSTRACT

A carburetor improvement comprises a flow passage through which fuel vapors created in a fuel bowl are drawn off to a chamber having a first outlet through which fuel vapors are directed to a canister and a second outlet through which fuel vapors are directed to an air passage in the carburetor. A solenoid includes a valve member movable between a first position opening the first outlet and closing the second outlet and a second position closing the first outlet and opening the chamber outlet. The valve member is moved to its first position when the engine is off so fuel vapors are collected in the canister and to its second position when the engine is operating so fuel vapors are directed to the air passage.

2 Claims, 4 Drawing Figures

CARBURETOR BOWL VENT

BACKGROUND OF THE INVENTION

This invention relates to carburetors and, more particularly, to apparatus for venting fuel vapors from the fuel bowl of a carburetor.

Carburetor assemblies typically include a fuel bowl holding fuel, e.g., gasoline, that is supplied to the engine on which the carburetor is installed. The gasoline gives off vapors and the presence of these vapors in the fuel bowl or bowls creates an internal bowl pressure which may result in an overly rich air-fuel mixture being produced in the carburetor and combusted in the engine.

By venting fuel vapors from the fuel bowl, the internal bowl pressure is balanced with the outside air pressure and better control over the air-fuel mixture is achieved. However, fuel vapors are continuously produced even when the engine is off and if they are continuously vented they eventually saturate the air space adjacent the carburetor's air inlet. These vapors gravitate into the carubretor's air horn and the intake manifold of the engine and may displace the air in these regions. Consequently, when the engine is next started, an overly rich air-fuel mixture is supplied to the engine which makes it more difficult to start.

Numerous bowl vent schemes have been used in previous carburetor designs to achieve bowl venting. One such scheme is shown in U.S. Pat. No. 4,157,366, issued June 5, 1979, to Ruth et al and assigned to the same assignee as the present application.

As shown therein, a bowl vent includes a valve member remotely located from an actuating device which moves the valve member through an intermediate structure. Such an arrangement while it effectively vents a fuel bowl under different engine operating conditions is mechanically complex and this may lead to failure of operation through mechanical breakdown.

SUMMARY OF THE INVENTION

Among the several objects of the present invention may be noted the provision of an improvement in venting fuel vapors from a fuel bowl of a carburetor, the provision of such an improvement which is of a simplified design not requiring intermediate operational mechanisms; the provision of such an improvement which is generally free from operating failures and is easily assembled on a carburetor; and the provision of such an improvement by which fuel vapors are readily vented from the fuel bowl regardless of whether an engine on which the carburetor is installed is operating or not.

Briefly, the improvement of the present invention comprises means defining at least one flow passage through which vapors created in the fuel bowl of a carburetor are drawn off from the fuel bowl. Fuel vapors drawn off from the fuel bowl are directed to a chamber having a first outlet through which fuel vapors are directed to a canister and a second outlet through which fuel vapors are directed to an air passage in the carburetor. An electrically operated solenoid includes a directly driven valve member movable between a first position opening the first chamber outlet and closing the second chamber outlet and a second position closing the first chamber outlet and opening the second chamber outlet. The valve member is moved to its first position when the engine is off so fuel vapors are collected in the canister and to its second position when the engine is operating so fuel vapors are directed to the air passage and are drawn into the engine. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
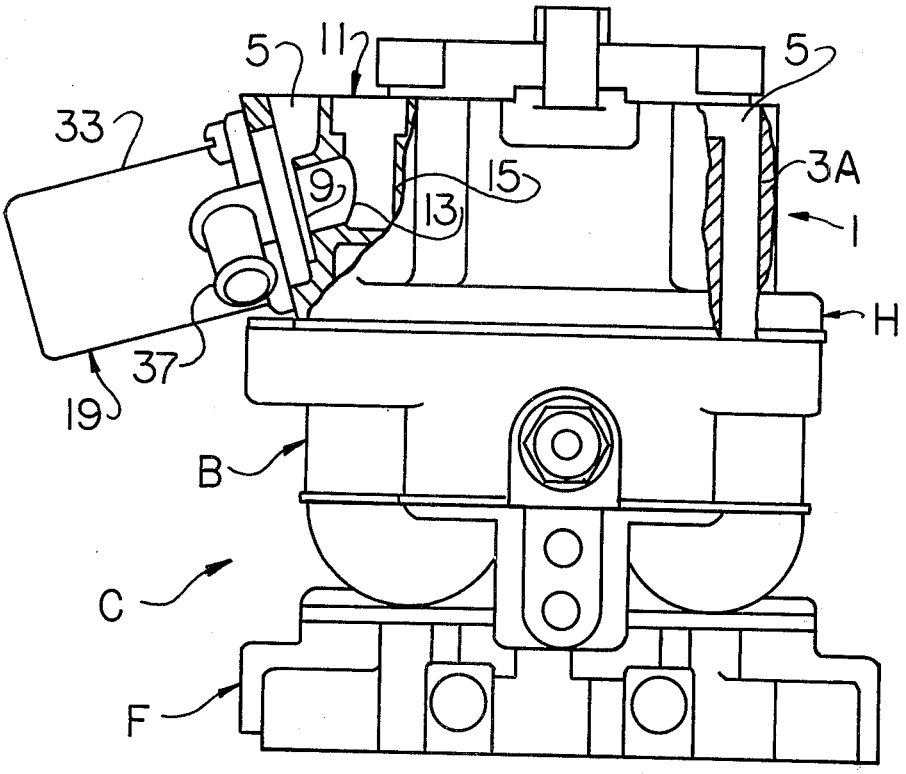
FIG. 1 is a rear elevational view of a carburetor, partly in section, illustrating the improvement of the present invention.

Referring to the drawings, a carburetor C is comprised of three sections, a flange section F, a body section B, and an air horn section H. A fuel bowl (not shown) is formed in body B and serves as a reservoir for fuel ultimately supplied to a carburetor air passage AP (see FIG. 2). Because the fuel in the fuel bowl, e.g. gasoline, is volatile, fuel vapors are created in the bowl. Carburetor C is mounted on an engine (not shown) and when the engine is running, the vapors are to be drawn into air passage AP and thence into the engine. When the engine is not operating, the fuel vapors are drawn off to a charcoal canister (also not shown).

Figure 3:
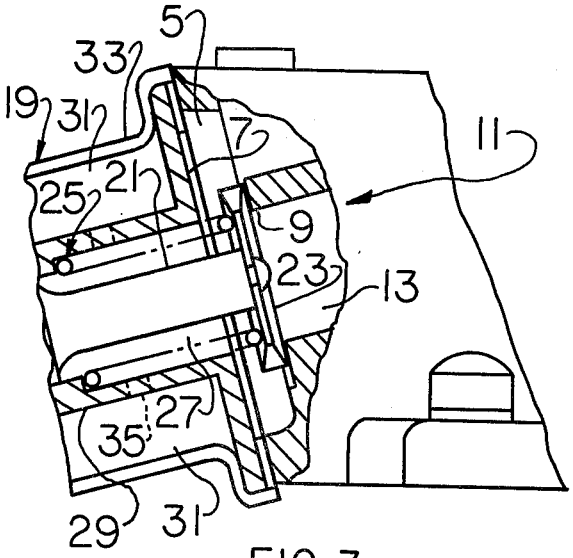
FIGS. 3 and 4 are sectional views of a portion of the improvement of the present invention illustrating its operation.
Figure 2:
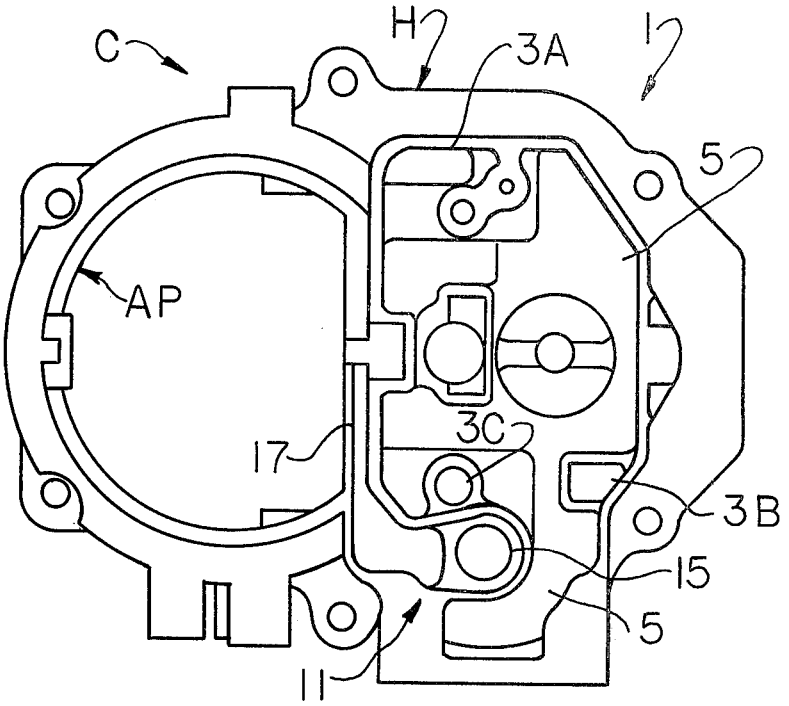
FIG. 2 is a top plan view of the carburetor of FIG. 1.
Figure 4:
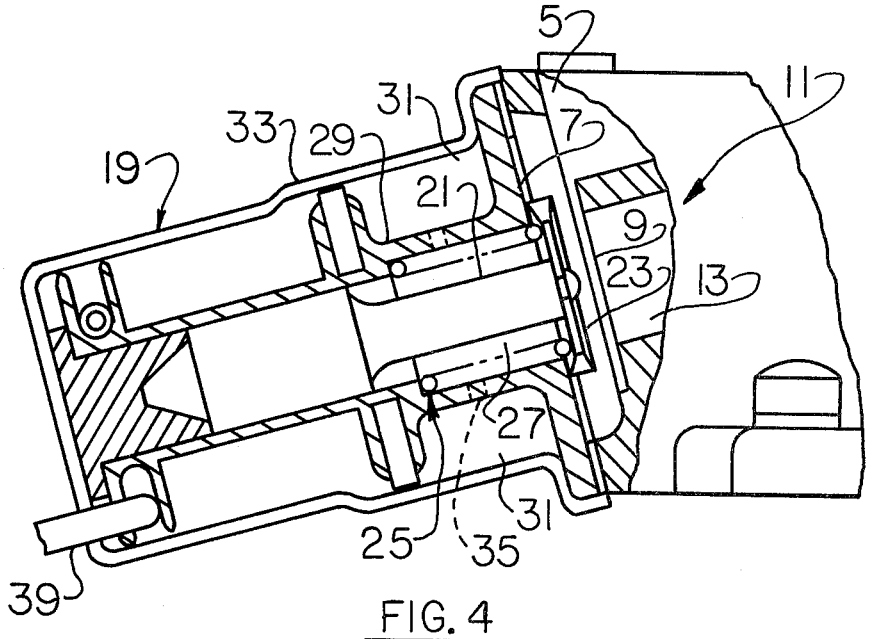

An improvement of the present invention comprises means 1 defining at least one air passage 3 through which fuel vapors are drawn off from the fuel bowl. Referring to FIGS. 1 and 2, three such passages designated 3A, 3B, and 3C respectively are formed in an air horn casting. Passages 3 are vertical passages through which fuel vapors rise up from the fuel bowl. Fuel vapors rising up from the fuel bowl enter into a large chamber 5. Referring to FIGS. 3 and 4, chamber 5 has two outlets, a first outlet 7 through which fuel vapors are directed to the canister and a second outlet 9 through which the fuel vapors are directed to air passage AP. Means 1 defines a flow passage 11 through which fuel vapors entering outlet 9 are directed to the air passage. Passage 11 includes an upwardly rising inlet section 13, a vertical passage 15 and a horizontal passage 17.

An electrically operated solenoid 19 is energized when the engine on which carburetor C is installed is running and is deenergized when the engine is shut off. Solenoid 19 has a movable armature 21 to one end of which is attached a valve member 23. Valve member 23 is disk shaped and is of sufficiently large diameter to close either outlet 7 or outlet 9. Valve member 23 is movable between two positions; a first position (FIG. 3) in which outlet 7 is open and outlet 9 is closed and a second position (FIG. 4) in which outlet 9 is open and outlet 7 is closed. A bias means 25 comprising a coil compression spring acts against the underside of valve member 23 to urge it in the direction to open outlet 7 and close outlet 9.

Armature 21 moves reciprocally in a chamber 27 defined by a circular wall 29. A circumferential outer chamber 31 is defined by wall 29 and housing 33 of the solenoid. A nipple 37 is integrally formed with the housing. One or more horizontal passages 35 interconnect chambers 27 and 31 and nipple 37 opens into chamber 31. A hose or other suitable conduit (not shown) connects nipple 37 with the charcoal canister. An electrical conductor 39 (see FIG. 4) is interconnected with the electrical system of the automobile in which carburetor C is installed and current is supplied to solenoid 19 via this conductor when the engine on which carburetor C is installed is turned on.

In operation, spring 25 forces valve member 23 to its position opening outlet 7 and closing outlet 9 when the engine is off. Fuel vapors created in the carburetor fuel bowl rise through the passages 3 to chamber 5 and are directed to the charcoal canister through outlet 7, chamber 27, passage 35, chamber 31 and nipple 37. When the engine is turned on, solenoid 19 is energized and armature 21 is drawn inwardly as indicated in FIG. 4 so valve member 23 closes outlet 7 and opens outlet 9. Fuel vapors entering chamber 5 are now drawn through passage 11 to air passage AP.

Unlike many prior art bowl vents, solenoid 19 directly affects opening and closing of the various outlets rather than acting on some intermediate mechanism which finally effectuates the opening or closing of an inlet or outlet port. As a consequence of the simple, yet functional approach of the present invention, ease of assembly is enhanced as is in-use operation. With fewer mechanical components involved, there is less risk of mechanical failure.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In a carburetor for an internal combustion engine, the carburetor having a fuel bowl in which fuel vapors are collected when the engine is not in operation and an air passage into which air is drawn into the engine when the engine is in operation, the improvement comprising means defining a flow passage through which vapors created in the fuel bowl are drawn off from the fuel bowl, a chamber to which fuel vapors drawn off from the fuel bowl are directed, the chamber having a first outlet through which fuel vapors drawn to the chamber are directed to the canister and a second outlet through which fuel vapors drawn to the chamber are directed to the air passage, the passage defining means defining a flow passage from the second outlet of the chamber to the air passage; and an electrically operated solenoid having a movable armature to one end of which is attached a valve member movable between a first position opening the first chamber outlet and closing the second chamber outlet and a second position closing the first chamber outlet and opening the second chamber outlet, the valve member being moved to its first position when the engine is off and to its second position when the engine is operating, and the solenoid having a housing and a circular inner wall within the housing, the wall defining a first chamber in which the armature moves and the wall and housing defining a second and outer chamber communicating with the first chamber via passages through the wall, and the housing having an opening communicating with the canister whereby fuel vapors directed to the canister when the valve member is moved to its first position flow to the canister through the first and second chambers formed within the solenoid.

2. The improvement as set forth in claim 1 wherein the solenoid further includes means biasing the valve member toward its second position, the biasing means moving the valve member from its first to its second position when the solenoid is deactuated.

* * * * *